United States Patent [19]

Timmes et al.

[11] Patent Number: 4,729,394

[45] Date of Patent: Mar. 8, 1988

[54] PORTABLE SCUBA EQUIPMENT FRAME

[76] Inventors: Daniel Timmes; Christopher G. Thornton, both of 535 Seabright La., Solana Beach, Calif. 92075

[21] Appl. No.: 864,817

[22] Filed: May 19, 1986

Related U.S. Application Data

[63] Continuation-in-part of Ser. No. 806,410, Dec. 9, 1985.

[51] Int. Cl.[4] ..... B08B 3/02

[52] U.S. Cl. ..... 134/199; 134/115 R; 239/450

[58] Field of Search ..... 134/115 R, 123, 137, 134/198, 199, 200, 170, 156, 145; 239/450; 211/127

[56] References Cited

U.S. PATENT DOCUMENTS

| | | | |
|---|---|---|---|
| 735,840 | 8/1903 | Strelitzer | 134/199 |
| 1,183,391 | 5/1916 | Mason | 134/123 |
| 1,427,877 | 9/1922 | Weeks | 134/137 X |
| 1,842,099 | 1/1932 | Johnson | 134/123 X |
| 2,407,533 | 9/1946 | Brock | 134/199 |
| 2,465,562 | 3/1949 | Hopper et al. | 134/199 X |
| 2,751,915 | 6/1956 | Roberts | 134/199 X |
| 3,353,546 | 11/1967 | Mahoney | 134/199 X |
| 3,511,252 | 5/1970 | Kennedy | 134/199 X |

FOREIGN PATENT DOCUMENTS

| | | | |
|---|---|---|---|
| 350263 | 6/1931 | United Kingdom | 134/123 |

*Primary Examiner*—Harvey C. Hornsby
*Assistant Examiner*—Frankie L. Stinson
*Attorney, Agent, or Firm*—Charmasson & Holz

[57] ABSTRACT

A portable frame for holding and washing scuba equipment comprised of a lower rack structure designed to hold the equipment and a tubular spraying assembly detachably mounted over said structure. The modular arrangement of the frame allows for multipurpose uses including maintenance, transportation and storage of such equipment.

8 Claims, 4 Drawing Figures

PORTABLE SCUBA EQUIPMENT FRAME

PRIOR APPLICATION

This application is a continuation-in-part of the prior application Ser. No. 806,410 filed Dec. 9, 1985 for PORTABLE SAILBOARD FRAME.

BACKGROUND OF THE INVENTION

This invention relates to a frame, and more particularly to a portable frame to facilitate the maintenance of scuba (self-contained underwater breathing apparatus) equipment and similar apparatus.

Scuba diving is a recreational activity where technological advances in equipment design have ensured the safety of individuals engaged in such activity. Maintenance of the scuba equipment is important because its failure while underwater can cause a diver serious injury. Thus, scuba equipment should be thoroughly rinsed and dried promptly after each use to prevent failure as well as to preserve the equipment. Presently, there is no known structure specifically designed to aid in the maintenance of such equipment.

SUMMARY OF THE INVENTION

An object of the present invention is to provide a frame to accommodate the numerous activities associated with maintenance of scuba equipment. The frame's modular features allow the structure to be easily assembled and disassembled, thus, the frame is portable and can be easily transported and loaded with diving gear.

Another object of the invention is to provide a frame which is durable and multifunctional. That is, the frame can be utilized for the rinsing, drying, storing, inspecting and transporting of scuba equipment and similar apparatus.

Still another object of the invention is to protect the scuba equipment while it is in storage. Protective material, such as shade cloth, can be utilized together will the lower part of the frame.

For the preferred embodiment of the invention, a portable frame comprises an upper structure assembled from tubular sections, a lower supporting structure to hold at least one piece of scuba equipment and a number of jets placed along both the upper and lower structures to spray the scuba gear. The structural elements of the frame are configured to efficiently support each component of scuba gear. Specifically, such elements include an angular shelf, to provide the needed drainage, a lower shelf, to support the oxygen tank; and clips along the side structure, to secure individual pieces of scuba equipment. Thus, the frame functionally provides for every phase of maintenance activity upon the initial placement of the equipment onto the frame.

DESCRIPTION OF THE PREFERRED EMBODIMENT OF THE INVENTION

Although the present invention is described in connection with maintenance applications for scuba equipment, it is to be understood that the invention is not limited thereto.

Figure 1:
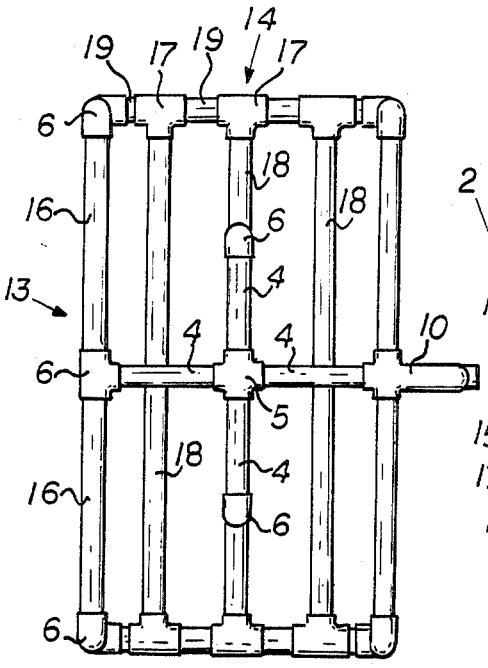
FIG. 1 is a top view of the portable scuba frame.
Figure 2:
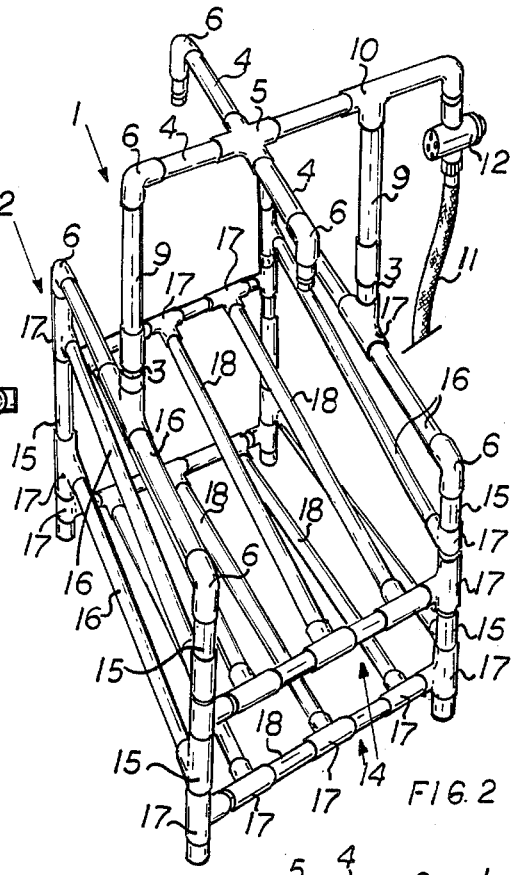
FIG. 2 is a perspective view of the portable scuba frame.
Figure 3:
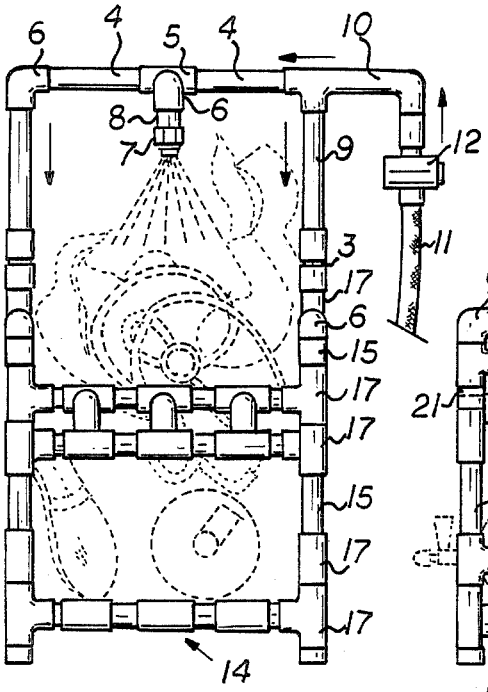
FIG. 3 is a front view of the portable scuba frame showing scuba equipment in phantom lines in corresponding receiving areas of the frame.
Figure 4:
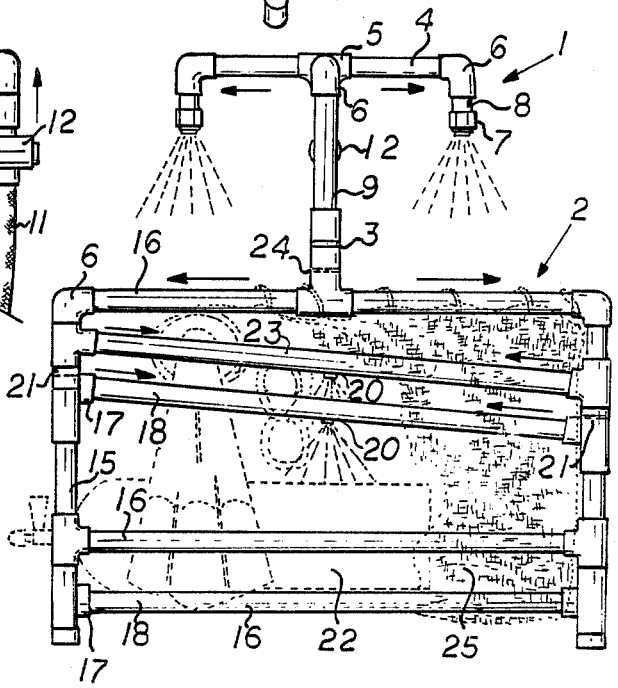
FIG. 4 is a side elevation view of the portable scuba frame showing the shadecloth and some of the scuba equipment in phantom lines.

FIGS. 1 through 4 show a preferred embodiment of the portable frame. More particularly, FIGS. 2–4 show that the frame consists of an upper tubular spraying assembly 1 and a lower supporting rack 2. The upper assembly 1 attaches to the lower rack 2 by transition nipples 3. This design facilitates the assembly and disassembly of the entire frame and enables the frame to be transportable.

Upper assembly 1 is comprised of two pairs of tubular members 4 that are interconnected in a cross-shaped arrangement by a multiple-outlet tee 5. Outer ends of one pair of tubular members 4 are attached by elbows 6 to a water jet configuration. The water jet configuration includes a jet 7 and a nipple 8. The length of nipple 8 can be varied or extended so that the distance from the jet assembly to the scuba gear can be varied. The jets 7 are positioned along a line that is parallel to the length of the frame.

Outer ends of the second pair of tubular members 4, which are perpendicularly disposed in relation to the first pair of tubular members 4, are connected to vertical members 9 by elbow 6 and an elbow extension 10. In addition to vertical member 9, elbow extension 10 is connected to water source (not shown) by a hose 11 and an inlet controller 12.

Lower structure 2 is comprised of a pair of vertical support sections 13 that are attached to horizontal shelves 14. Each support section 13 includes a plurality of vertical bars 15, horizontal members 16, elbows 6 and tees 17. Two shelves 14 interconnect with the vertical sections 13. Each shelf 14 essentially consists of a plurality of cross bars 18 that are attached by tees 17 to side members 19.

In a typical application shown in FIGS. 3 and 4, water flows through the frame from the hose 11 attached to inlet controller 12. Water is then sent to upper jets 7 and low sprayers 20. Plugs 21 are provided to prevent water from entering part of lower structure 2. This arrangement also helps to conserve water and maximize fluid pressure throughout the water conducting parts of the structure. The arrows in FIGS. 3 and 4 indicate the direction in which water flows as it moves through the scuba frame. For other applications of the present invention where water is not needed, the upper structure 1 can be removed and only the lower structure 2 can be used for transporting the equipment.

FIGS. 3 and 4 show additional features of the present invention. Lower structure 2 is designed to hold the scuba equipment. For example, an oxygen tank 22 is shown in phantom lines on the lower horizontal shelf 14. The upper shelf 14 is angular. This arrangement allows for proper drainage of items such as the wetsuit, buoyancy control device, regulator, safe second, time, depth, temperature and pressure monitors, compass, light and hood. This particular configuration is for illustrative purposes only. Of course, other structural arrangements are possible within the scope of principles described herein.

Further, FIGS. 3 and 4 show a number of clips 23 that can be hung onto horizontal member 6. Like the upper shelf 4, horizontal member 6 is also angular. The clips 23 are movable. Thus, articles such as gloves, booties, knife, abalone iron, dive bag, mask and snorkel can be placed conveniently along the lower structure 2.

Moreover, caps 24 can be attached to the lower frame 2 near the transition nipples 3 to prevent sand and other particles from entering the lower structure when the upper structure is removed. This feature is particularly important during transportation of the gear and while at a dive site.

Lastly, FIG. 4 shows a shadecloth 25 attached to the lower structure of the scuba frame. The shadecloth 25 serves as a net to secure the scuba equipment and serves additionally as a protective device from sunlight and the environment.

For complete protection from sunlight and the environment, a second covering (not shown) can also be used over the scuba frame. This covering can be used during storage of the equipment.

It can be seen from the foregoing description that the instant invention provides a frame for the efficient maintenance of scuba equipment. Cleaning gear is a simple process when the frame is used as compared to the cumbersome means utilized if each part of the equipment were cleaned manually. After a dive, ease of maintenance is a significant advantage over conventional methods.

The present invention also serves a number of functions in a practical manner. For example, the scuba frame can be used to carry all the scuba equipment to and from the dive site. To rinse the equipment later, the diver merely connects the upper structure to the lower structure and connects the hose.

Next, after the washing and rinsing are completed, the gear can be left on the frame because it can also be used as a drying frame.

In addition, when the upper structure is removed, the frame can be used as a storage frame in conjunction with a shadecloth.

Finally, the frame can be used to inspect the gear. Thus, these features demonstrate the multifunctional design of the instant invention. Upon placing the scuba equipment onto the frame, the scuba diver can maintain his or her equipment simply, conveniently and efficiently.

While the preferred embodiment of the invention has been described, modifications can be made and other embodiments may be devised within the spirit of the invention and the scope of the appended claims.

What is claimed is:

1. A portable frame for maintaining, transporting and storing scuba diving equipment and the like comprising:

a self-standing rack constructed from a plurality of tubular members said rack comprising:

at least one pair of substantially parallel vertical sections;

each of said vertical sections including at least two vertical members, a top transverse member spanning the upper ends of said two vertical members and obliquely positioned thereto, a bottom transverse member substantially horizontal and spanning the lower ends of said two vertical members;

at least two pairs of side members spanning the vertical sections in a plane perpendicular to said vertical sections, a plurality of first transverse members coplanar with said top transverse members and inwardly interconnecting said side members;

a plurality of second transverse members coplanar with said bottom transverse members and inwardly interconnecting said side members;

said first and second transverse members being positioned so as to form a supporting arrangement for said scuba equipment;

a spraying assembly detachably mounted over said rack, comprising a plurality of tubular members and a plurality of jets mounted thereon;

means for moving a washing fluid through the tubular sections of the spraying assembly and some tubular members of said rack.

2. The frame of claim 1, wherein said means for moving fluid includes an inlet controller mounted on one of said tubular members of said spraying assembly.

3. The frame of claim 1, wherein said spraying assembly and said rack are detachably connected to each other by transitiion nipples.

4. The frame of claim 3, wherein caps are attached near the transition nipples on said rack.

5. The frame of claim 1, wherein plugs are inserted in the tubular members of the upper portion of said rack to prevent fluid from moving throughout the entire rack.

6. The frame of claim 1, which further comprises a plurality of sprayers mounted on said top transverse members and said first transverse members.

7. The frame of claim 1, wherein clips are movably attached to said first transverse members of said rack.

8. The frame of claim 1, further comprising fabric retention means secured to the frame and surrounding the contents of the frame.

* * * * *